US005360334A

United States Patent [19]

Kagi, Sr.

[11] Patent Number: 5,360,334

[45] Date of Patent: Nov. 1, 1994

[54] WASTE OIL BURNER WITH PISTON-PUMP FOR FUEL ATOMIZATION AND DELIVERY

[76] Inventor: Thomas Kagi, Sr., P.O. Box 3637, Moscow, Id. 83843

[21] Appl. No.: 103,990

[22] Filed: Aug. 10, 1993

[51] Int. Cl.[5] ..... F23C 11/04

[52] U.S. Cl. ..... 431/1; 431/265; 239/88

[58] Field of Search ..... 431/265, 1; 239/89, 239/88; 417/490

[56] References Cited

U.S. PATENT DOCUMENTS

| | | | |
|---|---|---|---|
| 2,500,787 | 3/1950 | Lelgemann | 431/265 |
| 2,502,664 | 4/1950 | Nest | 431/265 |
| 5,042,718 | 8/1991 | Bergmann et al. | 239/88 |

*Primary Examiner*—Carroll B. Dority

[57] ABSTRACT

The present invention relates generally to devices designed for the combustion of liquid fuels and specifically to an improved apparatus for burning high-viscosity and waste oil. The subject invention utilizes a piston mechanism to transport fuel from its source to the subject burner. The piston mechanism, in conjunction with a pressure-sensitive valve device, also pressurizes the fuel to a predetermined level before releasing said fuel through a nozzle for pressurized dispersion atomization. The piston speed and stroke length can be adjusted in order to regulate fuel flow. After emission from the nozzle, the atomized fuel encounters a single-spark ignition device to induce flame. The atomized fuel and flame produced is enveloped by a unique retention head designed to promote complete fuel combustion and protect the burner chamber from over-heating.

2 Claims, 3 Drawing Sheets

WASTE OIL BURNER WITH PISTON-PUMP FOR FUEL ATOMIZATION AND DELIVERY

BACKGROUND

1. Field of Invention

The subject invention relates to burners used for the combustion of liquid fuels, specifically to an improved burner design for accommodating the unique properties of high-viscosity and waste oil.

In the United States alone, an estimated 3 billion gallons of waste oil are generated annually. Disposal of this potentially hazardous substance is possible in a number of different ways. Perhaps the most environmentally sound and economically efficient method is by combustion for commercial or domestic heating purposes.

Much of the waste oil produced in the United States is attributable to small establishments (i.e., small automotive repair shops and garages, businesses specializing in automotive oil changes, etc.). Burning waste oil to provide space heat or hot water for such operations would be preferable to paying the high costs of proper disposal or transportation for reprocessing. Unfortunately, the cost of waste oil burners in terms of initial capital outlay, installation, operation, and maintenance is often prohibitive. In addition, serious questions remain as to the safety and reliability of some waste oil burners on the market today.

Due to the unique and variable properties of waste oil supplies, conventional furnace oil burners, with their standard safety features, are not effective in the combustion of waste oil. Waste oil possesses characteristics far different from conventional furnace fuels; waste oil is typically very high in viscosity and replete with incombustible contaminants making combustion difficult by usual means. In addition, waste oil supplies frequently vary in viscosity and contaminant level and on occasion a waste oil furnace owner may choose to burn furnace fuel rather than waste oil in a waste oil burner. Therefore, it is important that a waste oil burner be easily and effectively adjustable to accommodate fuels of varying composition and viscosity.

The present invention proposes a unique and simple burner design that, when used in conjunction with an emissions scrubber such as that disclosed by U.S. Pat. No. 5,041,274, Aug. 20, 1991, Kagi, will provide a safe, efficient, cost-effective, and environmentally sound method of waste oil disposal.

2. Discussion of Prior Art

Overview of Conventional Waste Oil Burner Structure and Manner of Operation. Most waste oil burners operate in a similar manner: waste oil is filtered of contaminants and preheated in order to reduce oil viscosity. Next, a gear-driven oil pump transports oil to the burner from a remote source. On reaching the burner, the oil is suctioned through a low-pressure, aspiration-type nozzle by a compressed air current in order to break up the oil flow into a fine mist as required for proper combustion. The process of breaking up the oil flow into microscopic droplets is called "atomization." The atomized oil is then ignited by constant-spark electrodes. A constant spark is required to initiate and maintain combustion. In addition, prior art waste oil burners typically require oil solenoid valves to stop the flow of pressurized fuel through the nozzle after the burner is shut down.

Once flame is established, the combustion rate must be monitored to avoid "over-firing" or "under-firing" the furnace. Over-firing occurs when the flame length approaches the back wall, or "target", of the combustion chamber. Flame length increases with combustion rate in most waste oil furnaces because the secondary air required for combustion is fed parallel to the oil flow. If the combustion chamber is allowed to overheat, an explosion of the unit is possible; therefore, most waste oil burners have a fairly limited firing capacity and are engineered to shut down in the event of over-firing.

Under-firing is a less serious condition, usually caused by an excessively viscous fuel supply and is characterized by a weak, erratic flame and low heat output.

While numerous patents have been issued for waste oil burners of acceptable operation, all waste oil burners heretofore known suffer from a number of disadvantages:

Oil Preheating Required. Oil must be atomized into microscopic droplets in order to create greater surface area and achieve a complete burn. Waste oil is very high in viscosity; therefore, most waste oil burners preheat the oil in order to lower the viscosity and obtain maximum atomization. Unfortunately, heating waste oil to high temperatures also causes oil carbonization or "sludging" which can clog nozzles, thereby reducing burner efficiency or rendering the burner inoperable. The cost of high-temperature preheating also detracts from the economic savings sought by most waste oil furnace owners.

Remote Oil Pump and Compressed Air Supply Required. Most contemporary waste oil burners use a remote, gear-driven oil pump to convey oil from its source to a low-pressure suction nozzle for atomization. Because modern oil pumps achieve average pressures of only 100 psi, a compressed air flow is used to aerodynamically siphon the oil through an aspiration-type nozzle. External pump and compressed air requirements are costly and complicate furnace installation, operation, and maintenance. In addition, the colloidal, abrasive contaminants present in waste oil, even after filtration, drastically shorten the working use span of conventional oil pumps which are expensive to replace.

Most Lack Oil Flow Rate Control. Waste oil supplies frequently vary in viscosity and contaminant level and on occasion a waste oil furnace owner may choose to burn furnace fuel rather than waste oil in a waste oil burner. Therefore, it is important that a waste oil burner be easily adjustable to accommodate fuels of varying composition and viscosity to avoid burner over or under-firing.

Many contemporary waste oil burners do not feature an effective method of oil flow regulation making said burners susceptible to under-firing or over-firing. An under-firing condition, characterized by a weak, irregular flame and low heat output, may result if the oil flow rate cannot be adjusted to accommodate extremely high viscosity oil. A more serious and potentially dangerous situation is presented by burner over-firing.

If the oil flow rate of a burner cannot be adjusted for low viscosity fuel, inadvertent over-firing is possible. When oil pressure remains constant, low-viscosity oil is capable of flowing at an increased rate through a nozzle for ignition. An elevated oil flow rate may lead to an elongated flame, an over-firing precursor, in burners that feed secondary combustion air parallel to the oil flow.

Burner over-firing causes the cabinet to overheat and can result in an uncontrolled fire or explosion. Over-firing can be a potential problem, and source of danger for any burner transporting pressurized oil to an output nozzle without a means of oil flow control.

Many waste oil burners on the market today can be inadvertently over-fired, creating a extremely hazardous situations, because such burners do not possess a means of oil flow regulation. As a safety precaution, such burners usually contain an automatic switch to shut down the burner in the event of overheating. A consequence of such safety precautions is to limit BTU output.

Combustion Rate Necessarily Limited to Avoid Over-Firing. Conventional waste oil burners address the risk of over-firing and its associated hazards by limiting heat output. Waste oil burner manufacturers generally install a temperature-sensitive switch that will automatically shut down the burner in the event of over-heating. BTU output is necessarily limited in such designs since an increase in combustion rate varies directly with flame length and heat output.

Therefore, in order to provide a wide variety of BTU output levels, waste oil furnace manufacturers must generally produce several different-sized furnace models; one standard size furnace of the typical design, lacking an effective method of fuel flow rate control, is not capable of providing a widely variable heat output.

Constant Spark Ignitors Required. Most waste oil burners require constant spark ignitors to keep the burner in a continuously firing method. Constant spark ignitors have a relatively short working use expectancy and add to the cost of operating and maintaining a waste oil burner.

Oil Solenoid Valves Required. Conventional waste oil burners also require the use of an oil solenoid valve to stop the flow of pressurized oil through the nozzle after the burner ceases operation. The leakage of oil into a "cold" combustion chamber can result in difficult ignition, a foul smell and profuse smoke upon later burner operation, and the creation of deposits in the burner chamber leading to irregularities in burner performance. Oil solenoid valves add to the cost of manufacturing waste oil burners and potentially increase the cost of maintenance.

Secondary Air is Fed Parallel to the Oil Flow. The secondary air required for combustion in most modern waste oil burners is fed parallel to the flame through a blast tube or other air conduit. Consequently, an increase in combustion rate leads directly to an increase in flame length. Flame length must be carefully monitored in such burner designs to avoid over-firing.

Evaluation of Prior Patents

1. U.S. Pat. No. 5,149,260, Sep. 22, 1992, Foust, presents a closed-loop oil circulation and preheating apparatus involving an oil pump, oil preheating mode, self-cleaning "atomizing gun", and a control system. The atomizing gun allows preheated oil to be redirected from the circulatory loop to a low-pressure, aspiration-type nozzle where it is combined with compressed air and atomized for combustion. This system is most likely incapable of generating oil pressure at the nozzle in excess of 40 psi.

2. U.S. Pat. No. 4,487,571, Dec. 11, 1984, Robertson, et. al., utilizes a remote conventional oil pump to deliver fuel oil to an intermediate reservoir wherein a portion of the oil flow is sent through a restricted return line back to the fuel source. The restricted return line creates sufficient oil pressure to redirect a predetermined portion of the oil flow from the intermediate reservoir to a preheated aspiration-type nozzle for atomization and combustion. The system relies on a conventional oil pump, compressed air supply for atomization, and oil preheating. An oil solenoid valve would be necessary to stop post-operation oil leakage due to residual oil pressure at the nozzle. This system lacks a method of oil flow rate control and is particularly inappropriate for burning extremely high viscosity oil due to the nature of the fuel delivery system employed; the oil pressure induced by the restricted return line may not be sufficient to redirect extremely high viscosity oil to the nozzle at an adequate and constant rate. The potentially sluggish, irregular oil flow to the nozzle under such circumstances would result in a weak, erratic flame.

3. The burner apparatus embodied by U.S. Pat. No. 4,416,609, Nov. 22, 1983, Weber, discloses a complex fuel delivery system involving a closed-loop oil circulation system and a series of tanks or vessels. The vacuum effect of gas underpressure and overpressure is used to transport oil between the vessels and eventually out an atomizing nozzle for combustion. No conventional oil pumps are used; however, an air pump and compressed air supply are required to create the desired pressurization and vacuum effects. This system appears to lack a method of oil flow rate control and would probably require an oil solenoid-type valve to stop pressurized oil leakage from the nozzle after the burner ceases operation.

It should be noted that regulatory agencies group waste oil with gasoline as a "Class 1" highly-flammable substance. Most U.S. jurisdictions therefore limit or entirely prohibit the pressurization of Class 1 fuel storage vessels due to the associated risks of fire or explosion.

4. U.S. Pat. No. 3,914,094, Oct. 21, 1975, Landry, presents a waste oil burner intended for use on an oil well drilling barge and is designed to address the problems created by fluctuations in oil pressurization. The Landry burner is intended for use outdoors without a combustion chamber to enclose the burner and flame and utilizes natural gas for ignition. A remote oil pump is employed to pressurize the oil for transportation to the burner. A dill valve and bellows member act as a check valve on the oil flow to the nozzle and thereby ameliorate the effects of oil pressure fluctuations. The bellows member does not generate oil pressure but permits fuel pressurized by the remote oil pump to accumulate therein to a predetermined level (500 psig maximum) before the oil is released. After release from the bellows member, the fuel supply is siphoned by a compressed air flow through a nozzle and thereby atomized for combustion.

5. U.S. Pat. No. 3,720,496, Mar. 13, 1973, Briggs emphasizes a unique flame retention cone on a burner of typical design which mixes compressed air and fuel oil in a discharge nozzle for atomization and combustion. An oil solenoid valve would likely be required to stop the flow of oil through the nozzle post-operation. This invention appears to lack a method of oil flow rate control and the oil pressure level is probably between 20 and 30 psi at the nozzle.

While all of the above mentioned inventions disclose acceptable methods and apparatus for the combustion of waste oil, all require a compressed air supply or a conventional oil or air pump and constant spark janitors, none of which are required by the subject invention.

None of the above described prior art are designed to deliver and atomize the fuel supply in the same manner as the present method and apparatus. In addition, some of the prior art cited lack a method of oil flow rate control making them susceptible to over-firing or to low heat output associated with under-firing.

The prior disclosed art are therefore more complex, expensive and difficult to manufacture, install, operate and maintain, are necessarily more cumbersome and larger in size, have more elements susceptible to malfunction, and are not able to accommodate extreme fluctuations in fuel viscosity. In addition, the prior art may be less safe and reliable than the burner here presented.

Objects and Advantages

No Preheating of the Oil is Required. While preheating waste oil lowers the viscosity and facilitates atomization, the high-temperature preheating required by most waste oil burners increases carbonization and the tendency for nozzles to clog. Due to the elevated level of oil pressurization obtained by the present invention (approximately 3000 psi at the nozzle), oil preheating is not required to achieve thorough oil atomization and a complete burn. Any preheating employed to reduce oil viscosity would be at lower temperatures than required in standard waste oil burners.

Extremely High Oil Pressurization; No Compressed Air or Conventional Oil or Air Pump Required. The present invention utilizes a piston-based apparatus, a low-pressure vacuum method of transporting fuel to the burner, and a high-pressure dispersion method of atomizing said fuel without the prior art requirements of a conventional gear-driven oil pump, air pump, or compressed air supply.

The back-stroke of the piston apparatus creates a low-pressure area in a space over the fuel intake port and thereby suctions oil by venturi effect into the burner for combustion. In so doing, the piston apparatus satisfies the function of a conventional oil or air pump used for fuel delivery in the prior art.

The Kagi Burner eliminates the need for a compressed air supply by utilizing a high-pressure dispersion method of oil atomization rather than the traditional low-pressure, compressed air and aspiration nozzle method. The Kagi Burner pressurizes the fuel supply to levels approximating 3000 psi at the nozzle and forces the oil to atomize under pressure rather than by compressed air-assisted aspiration.

Oil Flow Rate is Adjustable. The rate at which fuel is supplied for combustion in the Kagi Burner may be controlled in two ways: 1) by altering the speed of the activating piston or 2) by varying the length of the piston stroke. The piston speed in the preferred embodiment is controlled by a variable speed motor; the piston stroke length can be altered by an adjustable drive cam, swing lever, or similar adjustment device. The Kagi Burner is therefore suitable for the combustion of a wide range of fuel compositions and viscosities and is less susceptible to over-firing caused by the introduction of low-viscosity fuel or to the weak, irregular flame attributable to the combustion of extremely high-viscosity oil.

In addition, the present invention's method of oil flow regulation provides a burner with an adjustable BTU output capable of meeting a wide range of individual heating needs.

Constant Spark Ignitors Required. Most waste oil burners require constant spark ignitors to keep the burner in a continuously firing mode. Constant spark ignitors have a relatively short working use expectancy and add to the cost of operating and maintaining a waste oil burner. The present invention does not, however, require constant spark ignitors to initiate and maintain combustion.

No Oil Solenoid Valve Required. In addition, the Kagi Burner does not require the use of an oil solenoid valve to halt the flow of oil through the nozzle after the burner has ceased operation. After the burner stops firing, the Kagi piston-pump design immediately interrupts positive pressure on the oil at the nozzle, thereby preventing leakage from the nozzle post-operation.

Unique Retention Head. While a ceramic chamber liner, standard retention head, or other flame barrier may be employed to promote complete combustion and protect the combustion chamber by controlling flame spread and dissipating heat, the preferred embodiment contemplates a retention head of unique design.

Said retention head is substantially conical in shape, the surface of which possesses a number of narrow, rectangular openings that run substantially the length of the retention head. A substantially rectangular louver extends from a longitudinal side of each opening and is angled inwardly toward the centerline of the retention head cone to channel secondary air in one direction around the interior retention head surface.

One or more air intake tubes are secured near the larger end of the retention head cone. Each tube shares its air intake opening with one of the narrow rectangular openings described above and extends inwardly toward the centerline of the retention head at substantially the same angle as the previously mentioned louvers. The output end of each air intake tube extends somewhat past the innermost edge of the louver to which it is adjacent. The intake tubes are designed to create additional air turbulence and resistance at the end of the retention head near the combustion chamber target wall to discourage flame elongation and over-firing.

The retention head openings are designed to create a secondary air flow around the interior surface of the retention head which envelopes the atomized oil flow and flame in a circular, spinning fashion. The aerodynamic effect produced by the openings forces the oil mist and flame toward the centerline of the retention head while containing the oil supply and flame close to the nozzle and away from the combustion chamber target wall.

Secondary Air Enters Substantially Perpendicular to the Flame. In addition to dissipating heat and controlling flame spread within the combustion chamber (the objective of any burner flame barrier or retention head), the depicted retention head better channels the atomized oil and promotes complete combustion.

The spinning air flow addresses the atomized oil from all sides at roughly right angles as it exits the nozzle immediately prior to combustion. Any oil droplets larger in size than required for complete, clean combustion would be forced into the combustion zone by the spinning air flow, rather than being allowed to deviate and collect on the retention head interior.

The retention head depicted in the preferred embodiment also allows secondary air to encounter the flame in a circular, spinning fashion thereby forcing the flame to increase in girth, rather than elongate, when the oil combustion rate is elevated. The retention head described thereby serves as an inherent guard against inadvertent over-firing by reducing the likelihood that the flame will reach the combustion chamber target wall.

Because a higher combustion rate can be achieved with a reduced risk of excessive flame elongation and over-firing, the Kagi Burner permits greater BTU output from a smaller-sized burner than heretofore possible.

Accordingly, aside from the objects and advantages of the waste oil burner described above, several objects and advantages of the present invention are:

(a) to provide a waste oil burner of safe, effective, efficient, and reliable operation;

(b) to provide a durable, low-maintenance waste oil burner;

(c) to provide a waste oil burner that does not require conventional oil or air pumps for fuel delivery;

(d) to provide a waste oil burner that does not require a compressed air supply for oil atomization;

(e) to provide a waste oil burner with an adjustable oil flow rate to accommodate a wide range of fuel compositions and viscosities;

(f) to provide a waste oil burner that does not leak fuel into the combustion chamber after the burner ceases operation without the use of oil solenoid valves;

(g) to provide a waste oil burner that does not require high-temperature fuel pre-heating;

(h) to provide a waste oil burner with a retention head that protects the combustion chamber by dissipating heat and controlling flame spread, limiting flame elongation, and promoting complete combustion;

(i) to provide a waste oil burner that is inexpensive to manufacture and is therefore affordable for purchase by small business owners;

(j) to provide a waste oil burner that is inexpensive to ship, install, operate, and maintain;

(k) to provide a waste oil burner that is simple to use and easy to adjust and maintain; and (l) to provide a waste oil burner of relatively compact size and high BTU output.

Further objects and advantages are to provide a burner with an oil dispersion system that is capable of forming atomized fuel into a pattern in order to better regulate the flame produced and to provide a "one size fits all" burner with an adjustable BTU output that reduces or eliminates the need for manufacturers to offer several different furnace sizes to meet individual consumer heating requirements.

SUMMARY

The Kagi Burner replaces the remote, gear-driven oil pump used for fuel delivery in most waste oil burners with a simple piston-pump mechanism. The present invention further eliminates the prior art requirements of a compressed air supply and aspiration-type nozzle for oil atomization, high-temperature preheating, constant spark ignitors, and oil solenoid valves. The simple design thereby allows for less expensive manufacture, shipping, installation, operation, and maintenance than for burners previously contemplated.

The Kagi Burner also provides an efficient means for oil flow regulation, permitting safer, more reliable and accommodating operation than the prior art. The present invention thereby provides an adjustable heat output furnace with a higher maximum BTU output level in a smaller size than ever before possible.

The preferred embodiment features a flame retention head that dissipates heat, controls flame spread, ensures a complete burn, and allows for operation at a higher combustion rate (for greater BTU output) with a substantially reduced risk of furnace over-firing.

Further objects and advantages of this invention will become apparent from a consideration of the drawings and ensuing description.

LIST OF DRAWING REFERENCE NUMERALS

Figure 1:
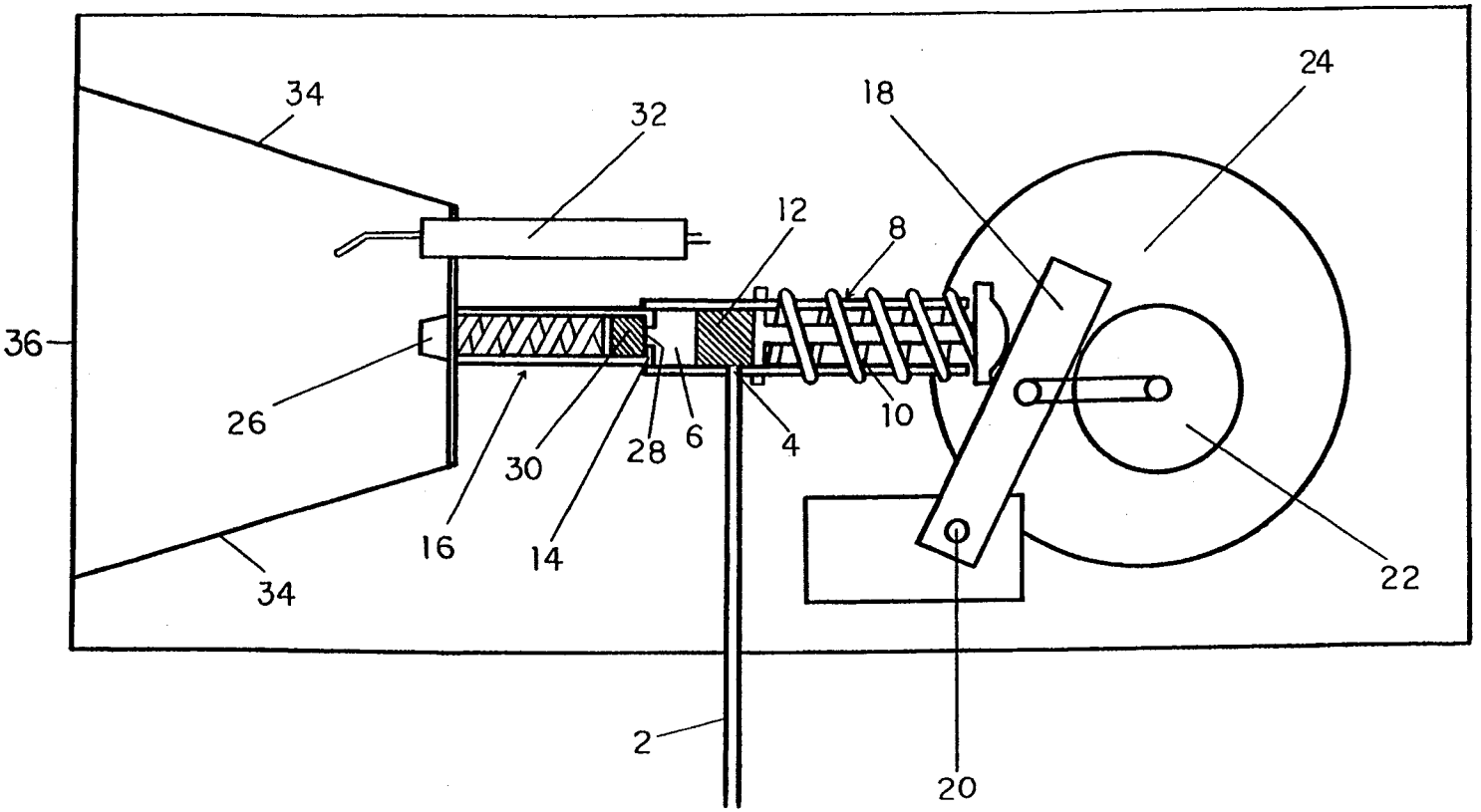
FIG. 1 shows a side view of the preferred embodiment.
Figure 2:
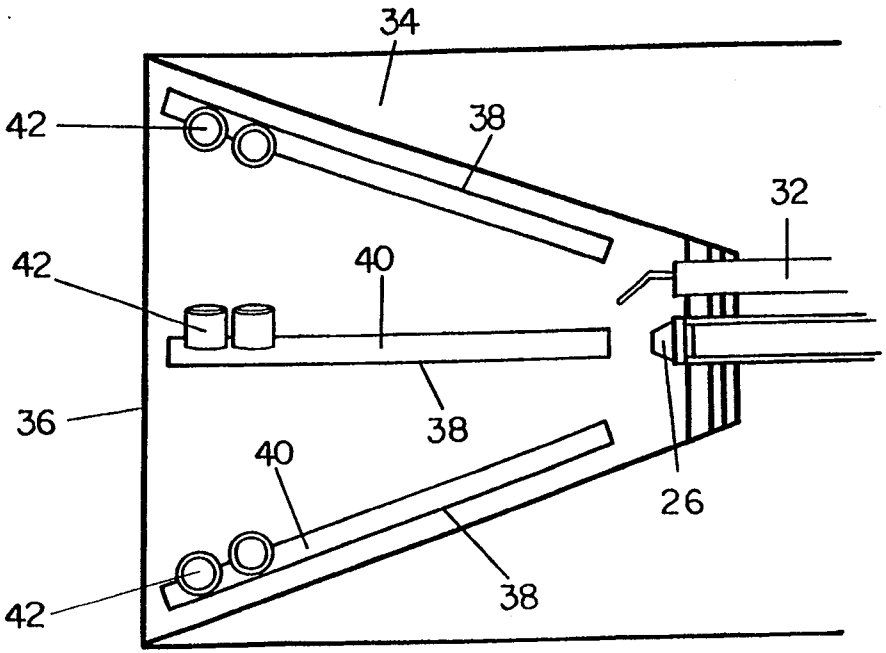
FIG. 2 shows a side view of the preferred retention head embodiment.
Figure 3:
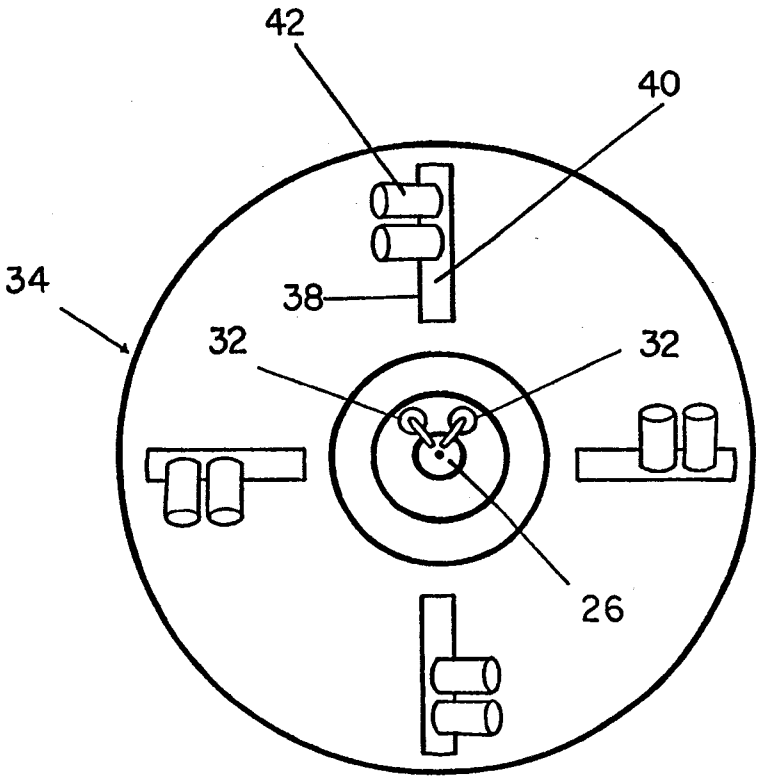
FIG. 3 shows a frontal view of the preferred retention head embodiment.

| | |
|---|---|
| 2. fuel feed line | 4. fuel intake port |
| 6. primary chamber | 8. piston mechanism |
| 10. piston return mechanism | 12. piston mechanism head |
| 14. separation wall | 16. secondary chamber |
| 18. lever | 20. fulcrum |
| 22. drive cam | 24. motor |
| 26. nozzle | |
| 28. opening(s) in separation wall (14) | |
| 30. pressure-sensitive valve or spring-loaded seal | |
| 32. ignition device | |
| 34. flame retention head | |
| 36. combustion chamber "target" wall | |
| 38. opening in retention head surface | |
| 40. louver on retention head surface | |
| 42. air intake tubes on retention head cone | |

SUMMARY OF THE INVENTION

The subject invention presents an improved method and apparatus for the delivery, atomization, and combustion of liquid fuels, including high-viscosity and waste oil, at a variable rate, with a greater BTU output capacity and reduced risk of furnace over or under-firing, in a smaller size and with fewer elements than the prior art.

The basis of the invention is a piston pump mechanism which eliminates the prior art requirements of a gear-driven oil pump, compressed air supply, high-temperature oil preheating, constant spark ignitors, and oil solenoid valves.

There has thus been outlined rather broadly the more important features of this invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangement of the components as set forth in the following description or as illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office, the public generally, and the especially the scientists, engineers, and practitioners in the art who are not familiar with patent or legal terms and phraseology to determine quickly from a cursory inspection, the nature and essence of the technical disclosure of the application. The abstract is neither intended to define the invention of the application, which is measured by the claims, nor is it intended to be limiting as to the scope of the invention in any way.

Therefore, the objects of the present invention are:

(a) to provide a waste oil burner of safe, effective, efficient, and reliable operation;

(b) to provide a durable, low-maintenance waste oil burner;

(c) to provide a waste oil burner that does not require conventional oil or air pumps for fuel delivery;

(d) to provide a waste oil burner that does not require a compressed air supply for oil atomization;

(e) to provide a waste oil burner with an adjustable oil flow rate to accommodate a wide range of fuel compositions and viscosities;

(f) to provide a waste oil burner that does not leak fuel into the combustion chamber after the burner ceases operation without the use of oil solenoid valves;

(g) to provide a waste oil burner that does not require high-temperature fuel pre-heating;

(h) to provide a waste oil burner with a retention head that protects the combustion chamber by dissipating heat and controlling flame spread, limiting flame elongation, and promoting complete combustion;

(i) to provide a waste oil burner that is inexpensive to manufacture and is therefore affordable for purchase by small business owners;

(j) to provide a waste oil burner that is inexpensive to ship, install, operate, and maintain;

(k) to provide a waste oil burner that is simple to use and easy to adjust and maintain; and (l) to provide a waste oil burner of relatively compact size and high BTU output.

Further objects and advantages are to provide a burner with an oil dispersion system that is capable of forming atomized fuel into a pattern in order to better regulate the flame produced and to provide a "one size fits all" burner with an adjustable BTU output that reduces or eliminates the need for manufacturers to offer several different furnace sizes to meet individual consumer heating requirements.

These, together with other objects of the invention, along with the various features of novelty which characterize the invention, are specified in the claims annexed to and forming part of this disclosure. For a better understanding of the invention, its advantages and the specific objects attained by its uses, reference should be made to the accompanying drawings and descriptive matter in which there are illustrated preferred embodiments of the invention.

Narrative Description

The preferred embodiment presents a waste oil source (not shown) connected by a fuel feed line (2) to an intake port (4) on the "primary chamber" (6) of the burner apparatus. The primary chamber (6) is created by the back-stroke of a piston mechanism (8) and is diminished when a return mechanism (10) replaces the piston mechanism head (12) to a position in close proximity to a wall (14) separating the primary chamber (6) and adjacent secondary chamber (16). In the preferred embodiment, the piston mechanism head (12) employed is relatively small in diameter to produce an elevated pressurization per square inch and is composed of a tungsten steel alloy for durability.

The piston mechanism (8) is activated by a lever (18), fulcrum (20), and variable-speed motor (24) with a double cam (22) or other means of conveying reciprocal motion at an adjustable rate.

The secondary chamber (16), adjacent to the primary chamber (6), has a nozzle (26) on the output side, opposite the primary chamber (26). Said nozzle (6) may contain a spinner disk or specially-shaped opening or pattern of openings to alter oil dispersion.

The primary (6) and secondary chambers (16) are divided by a separation wall (14) which has one or more small openings (28) to allow for the passage of oil. The secondary chamber (16) contains a spring loaded seal or other pressure-sensitive valve device (30) for alternatingly sealing and releasing fuel through the separation wall opening(s) (28).

The output end of the nozzle (26) is located in close proximity to a set of ignition electrodes (32) or other ignition device.

In the preferred embodiment, the nozzle (26) and electrodes (32) are enveloped by a unique flame retention head (34); however, any flame barrier, baffle, chamber liner or other means of chamber protection, heat dissipation, and flame spread control that promotes a complete burn could be employed.

Explanation of Operation

After being filtered and otherwise prepared for combustion, waste oil is drawn from a remote source (not shown) through a fuel feed line (2) to a fuel intake port (4). The suction necessary to deliver oil to the burner is created by the back-stroke of a piston mechanism (8). The back-stroke of the piston mechanism (8) creates a low-pressure area above the fuel intake port (4) and in front of the piston mechanism head (12); thereby the piston mechanism (8) suctions oil by venturi effect from the fuel feed line (2) through the fuel intake port (4) into the low-pressure area (the "primary chamber") (6).

The forward stroke of the piston mechanism (8) is assisted by a return mechanism (10), a spring-like device in the preferred embodiment. On the forward stroke of the piston mechanism (8), the primary chamber (6) is diminished while the piston mechanism head (12) seals the fuel intake port (4) to prevent oil back-flow into the piston mechanism (8) assembly.

The primary chamber (6) is separated from an adjacent secondary chamber (16) by a separation wall (14) having one or more small opening(s) (28) which allow for the passage of fuel. The openings (28) may be arranged so as to disperse atomized fuel in a desired pattern.

The secondary chamber (16) employs a spring-loaded seal or other pressure-sensitive valve device (30) which alternatingly seals the separation wall openings (28) and releases the fuel supply, allowing fuel to accumulate and pressurize to a predetermined level in the primary chamber (6) before it is released through the separation wall opening(s) (28) into the secondary chamber (16). The amount of oil pressure gathered before release into the secondary chamber (16) can be altered by varying the seal (30) pressure tolerance.

Any means of inducing the piston mechanism (8) into motion may be employed; however, in the preferred embodiment, the piston mechanism (8) is activated by an oscillating lever (18) with a fulcrum (20) attached to a double cam (22) on a variable-speed motor (24). The motor drive (24) can be moved in or out to vary the stroke length of the piston mechanism (8). Alternatively, the swing lever (18) can be equipped with a moveable stop to vary the rate of oil flow.

Once in the secondary chamber (16), the pressurized oil is forced through a nozzle (26) which thoroughly atomizes the oil by pressurized dispersion. The atomized oil is then ignited by a set of electrodes (32) or other ignition device. The electrodes (32) can be extinguished after flame is established because a constant spark is not required for maintenance of flame.

In the preferred embodiment, the nozzle (26) and electrodes (32) are enveloped by a unique flame retention head (34), however, any flame barrier, baffle, chamber liner or other means of chamber protection, heat dissipation, and flame spread control that promotes complete combustion could be employed.

The retention head (34) contemplated is substantially conical in shape, the surface of which possesses a number of narrow, rectangular openings (38) that run substantially the length of the retention head (34). A substantially rectangular louver (40) extends from a longitudinal side of each opening (38) and is angled inwardly toward the centerline of the retention head (34) to channel secondary air in one direction around the interior retention head (34) surface.

One or more air intake tubes (42) are secured near the larger end of the retention head (34). Each intake tube (42) shares its air intake opening with one of the narrow rectangular openings (38) described above and extends inwardly toward the centerline of the retention head (34) at substantially the same angle as the previously mentioned louvers (40). In the preferred embodiment, the output end of each air intake tube (42) extends past the innermost edge of the louver (40) to which it is adjacent. Secondary air for combustion enters said intake tubes (42) which are designed to create additional air turbulence and resistance at the end of the retention head (34) near the combustion chamber target wall (36) to discourage flame elongation and over-firing.

The retention head openings (38) create a secondary air flow around the interior surface of the retention head (34) which envelopes the atomized oil flow and flame in a circular, spinning fashion. The aerodynamic effect produced by the openings (38) forces the atomized fuel and flame toward the centerline of the retention head (34), while containing the fuel supply and flame close to the nozzle (26) and away from the combustion chamber target wall (36).

Secondary Air Enters Substantially Perpendicular to the Flame. In addition to dissipating heat and controlling flame spread within the combustion chamber (the objective of any flame barrier or retention head), the depicted retention head (34) better channels the atomized oil and promotes complete combustion.

The spinning air flow addresses the atomized oil from all sides at roughly right angles as it exits the nozzle (26) immediately prior to ignition by adjacent electrodes (32). Any oil droplets larger in size than required for complete, clean combustion would be forced into the combustion zone by the spinning air flow, rather than being allowed to deviate and collect on the retention head (34) interior.

The retention head (34) depicted in the preferred embodiment also allows secondary air to encounter the flame in a circular, spinning fashion thereby forcing the flame to increase in girth, rather than elongate, when the oil combustion rate is elevated. The retention head (34) described thereby serves as an inherent guard against inadvertent over-firing by reducing the likelihood that the flame will reach the combustion chamber target wall (36).

Because a higher combustion rate can be achieved with a reduced risk of excessive flame elongation and over-firing, the Kagi Burner permits greater BTU output from a smaller-sized burner than heretofore possible.

Conclusion

Thus, the reader will see that the subject invention provides a simple, efficient, economical, and safe device designed for the combustion of liquid fuels, including high-viscosity and waste oil.

The present invention has been described herein as including various specific strictures, However, it will be apparent to those skilled in the art that various modifications or rearrangements of the described parts can be made without departing from the spirit and scope of the underlaying inventive concept. Thus, the present invention is not limited to the particular forms shown and described herein and reference is directed to the appended claims for a determination of the scope thereof.

I claim:

1. An apparatus for the delivery, atomization, and combustion of liquid fuels, including high-viscosity and waste oil, comprising:

a. In combination, a piston contained in a cylinder with a barrier wall at the forward end of the cylinder and a means for engaging said piston in reciprocal motion at the opposite end;

b. said barrier wall having one or more openings;

c. said piston intermittently forming a primary chamber space in the cylinder between the head portion of the piston nearest the barrier wall and said barrier wall when said piston is in a back stroke position while engaged in reciprocal motion;

d. a fuel delivery tube connecting a remote liquid fuel source with the primary chamber space and located in relation to the piston such that fuel is drawn into the primary chamber space by an intermittent low-pressure vacuum caused by the back stroke of said piston and such that, on the forward stroke of said piston, the piston seals off the fuel delivery tube from the primary chamber space while simultaneously pressurizing fuel in the forward portion of the primary chamber;

e. a secondary chamber space inside the cylinder, between the barrier wall and an atomization output nozzle located on the end of the cylinder opposite the primary chamber;

f. a pressure sensitive seal device located inside the secondary chamber, intermittently sealing the openings in the barrier wall, thereby allowing the alternating pressurization of fuel inside the primary chamber by the forward stroke of the piston, and subsequent release of said fuel through the barrier wall openings into the secondary chamber and exiting through an atomization output nozzle upon said fuel reaching a predetermined level of pressurization;

g. an ignition device in close proximity to the output end of the atomization nozzle, capable of igniting the atomized fuel as it exits the nozzle;

h. a conical shaped retention head, enveloping the nozzle and ignition device and having a plurality of rectangular openings angled to a centerline of said retention head and each having a louver extending from a longitudinal side of said opening, an air tube connected to said retention head to supply air to said openings, said louvers being arranged to swirl the air in a common direction to promote complete fuel combustion, control flame spread and dissipate heat.

2. The apparatus as described in claim 1 wherein said means for engaging said piston for reciprocal motion including a variable speed motor activating said piston into reciprocal motion, thereby allowing the regulation of fuel flow and combustion.

* * * * *